US006029132A

United States Patent [19]

Kuhn et al.

[11] Patent Number: 6,029,132

[45] Date of Patent: Feb. 22, 2000

[54] METHOD FOR LETTER-TO-SOUND IN TEXT-TO-SPEECH SYNTHESIS

[75] Inventors: Roland Kuhn; Jean-Claude Junqua, both of Santa Barbara, Calif.

[73] Assignee: Matsushita Electric Industrial Co., Kadoma Osaka, Japan

[21] Appl. No.: 09/070,300

[22] Filed: Apr. 30, 1998

[51] Int. Cl.[7] ..... G10L 5/00; G10L 9/00

[52] U.S. Cl. ..... 704/260; 704/258; 704/259

[58] Field of Search ..... 704/260, 258, 704/259

[56] References Cited

U.S. PATENT DOCUMENTS

| | | | |
|---|---|---|---|
| 3,704,345 | 11/1972 | Coker et al. | 704/260 |
| 4,979,216 | 12/1990 | Malsheen et al. | 704/260 |
| 5,636,325 | 6/1997 | Farrett | 704/267 |

OTHER PUBLICATIONS

Sullivan et al. "a psyhologically–governed approach to novel–word pronunciation within a text–to–speech system" IEEE pp. 341–344, 1990.

O'malley et al. "text to speech conversion technology" IEEE pp. 17–23, Aug. 1990.

*Primary Examiner*—David R. Hudspeth
*Assistant Examiner*—Daniel Abebe
*Attorney, Agent, or Firm*—Harness, Dickey & Pierce, P.L.C.

[57] ABSTRACT

A two-stage pronunciation generator utilizes mixed decision trees that includes a network of yes-no questions about letter, syntax, context, and dialect in a spelled word sequence. A second stage utilizes decision trees that includes a network of yes-no questions about adjacent phonemes in the phoneme sequence corresponding to the spelled word sequence. Leaf nodes of the mixed decision trees provide information about which phonetic transcriptions are most probable. Using the mixed trees, scores are developed for each of a plurality of possible pronunciations, and these scores can be used to select the best pronunciation as well as to rank pronunciations in order of probability. The pronunciations generated by the system can be used in speech synthesis and speech recognition applications as well as lexicography applications.

34 Claims, 3 Drawing Sheets

METHOD FOR LETTER-TO-SOUND IN TEXT-TO-SPEECH SYNTHESIS

BACKGROUND AND SUMMARY OF THE INVENTION

The present invention relates generally to speech processing. More particularly, the invention relates to a system for generating pronunciations of spelled words. The invention can be employed in a variety of different contexts, including speech recognition, speech synthesis and lexicography.

Spelled words are also encountered frequently in the speech synthesis field. Present day speech synthesizers convert text to speech by retrieving digitally-sampled sound units from a dictionary and concatenating these sound units to form sentences.

Heretofore most attempts at spelled word-to-pronunciation transcription have relied solely upon the letters themselves. These techniques leave a great deal to be desired. For example, a letter-only pronunciation generator would have great difficulty properly pronouncing the word "read" used in the past tense. Based on the sequence of letters only the letter-only system would likely pronounce the word "reed", much as a grade school child learning to read might do. The fault in conventional systems lies in the inherent ambiguity imposed by the pronunciation rules of many languages. The English language, for example, has hundreds of different pronunciation rules, making it difficult and computationally expensive to approach the problem on a word-by-word basis.

The present invention addresses the problem from a different angle. The invention uses a specially constructed mixed-decision tree that encompasses letter sequence, syntax, context and dialect decision-making rules. More specifically, the letter-syntax-context-dialect mixed-decision trees embody a series of yes-no questions residing at the internal nodes of the tree.

Some of these questions involve letters and their adjacent neighbors in a spelled word sequence (i.e., letter-related questions); other questions examine what words precede or follow a particular word (i.e.. context-related questions); other questions examine what part of speech the word has within a sentence as well as what syntax other words have in the sentence (i.e., syntax-related questions); still other questions examine what dialect it is desired to be spoken.

The internal nodes ultimately lead to leaf nodes that contain probability data about which phonetic pronunciations and stress of a given letter are most likely to be correct in pronouncing the word defined by its letter and word sequence.

The pronunciation generator of the invention uses mixed-decision trees on the word-level to score different pronunciation candidates, allowing it to select the most probable candidate as the best pronunciation for a given spelled word. Generation of the best pronunciation is preferably a two-stage process in which a set of letter-syntax-context-dialect mixed-decision trees is used in the first stage to generate a plurality of pronunciation candidates with scores indicating an order of preference. These candidates are then rescored using a second set of mixed-decision trees in the second stage to select the best candidate. This second set of mixed decision trees examines the word at the phoneme level.

For a more complete understanding of the invention, its objects and advantages, reference may be had to the following specification and to the accompanying drawings.

DESCRIPTION OF THE PREFERRED EMBODIMENT

Figure 1:
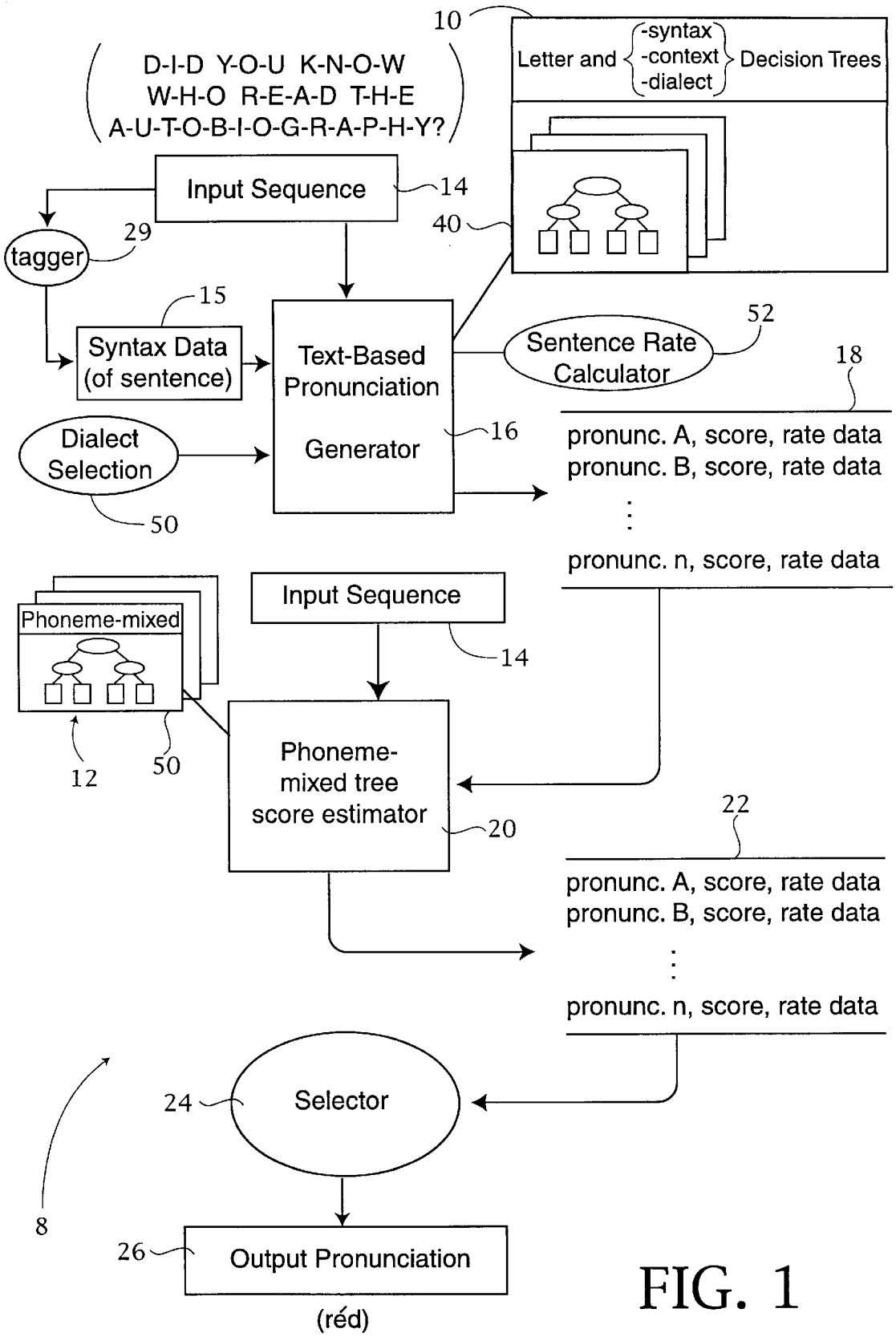
FIG. 1 is a block diagram illustrating the components and steps of the invention.

To illustrate the principles of the invention the exemplary embodiment of FIG. 1 shows a two stage spelled letter-to-pronunciation generator 8. As will be explained more fully below, the mixed-decision tree approach of the invention can be used in a variety of different applications in addition to the pronunciation generator illustrated here. The two stage pronunciation generator 8 has been selected for illustration because it highlights many aspects and benefits of the mixed-decision tree structure.

The two stage pronunciation generator 8 includes a first stage 16 which preferably employs a set of letter-syntax-context-dialect decision trees 10 and a second stage 20 which employs a set of phoneme-mixed decision trees 12 which examine input sequence 14 at a phoneme level. Letter-syntax-context-dialect decision trees examine questions involving letters and their adjacent neighbors in a spelled word sequence (i.e., letter-related questions); other questions examined are what words precede or follow a particular word (i.e., context-related questions); still other questions examined are what part of speech the word has within a sentence as well as what syntax other words have in the sentence (i.e., syntax-related questions); still further questions examined are what dialect it is desired to be spoken. Preferably, a user selects which dialect is to be spoken by dialect selection device 50.

An alternate embodiment of the present invention includes using letter-related questions and at least one of the word-level characteristics (i.e., syntax-related questions or context-related questions). For example, one embodiment utilizes a set of letter-syntax decision trees for the first stage. Another embodiment utilizes a set of letter-context-dialect decision trees which do not examine syntax of the input sequence.

It should be understood that the present invention is not limited to words occurring in a sentence, but includes other linguistical constructs which exhibit syntax, such as fragmented sentences or phrases.

An input sequence 14, such as the sequence of letters of a sentence, is fed to the text-based pronunciation generator 16. For example, input sequence 14 could be the following sentence: "Did you know who read the autobiography?"

Syntax data 15 is an input to text-based pronunciation generator 16. This input provides information for the text-based pronunciation generator 16 to correctly course through the letter-syntax-context-dialect decision trees 10. Syntax data 15 addresses what parts of speech each word has in the input sequence 14. For example, the word "read" in the above input sequence example would be tagged as a verb (as opposed to a noun or an adjective) by syntax tagger software module 29. Syntax tagger software technology is available from such institutions as the University Pennsylvania under project "Xtag." Moreover, the following reference discusses syntax tagger software technology: George Foster, "Statistical Lexical Disambiguation", Masters Thesis in Computer Science, McGill University, Montreal, Canada (Nov. 11, 1991).

The text-based pronunciation generator 16 uses decision trees 10 to generate a list of pronunciations 18, representing possible pronunciation candidates of the spelled word input sequence. Each pronunciation (e.g., pronunciation A) of list 18 represents a pronunciation of input sequence 14 including preferably how each word is stressed. Moreover, the rate at which each word is spoken is determined in the preferred embodiment.

Sentence rate calculator software module 52 is utilized by text-based pronunciation generator 16 to determine how quickly each word should be spoken. For example, sentence rate calculator 52 examines the context of the sentence to determine if certain words in the sentence should be spoken at a faster or slower rate than normal. For example, a sentence with an exclamation marker at the end produces rate data which indicates that a predetermined number of words before the end of the sentence are to have a shorter duration than normal to better convey the impact of an exclamatory statement.

The text-based pronunciation generator 16 examines in order each letter and word in the sequence, applying the decision tree associated with that letter or word's syntax (or word's context) to select a phoneme pronunciation for that letter based on probability data contained in the decision tree. Preferably the set of decision trees 10 includes a decision tree for each letter in the alphabet and syntax of the language involved.

Figure 2:
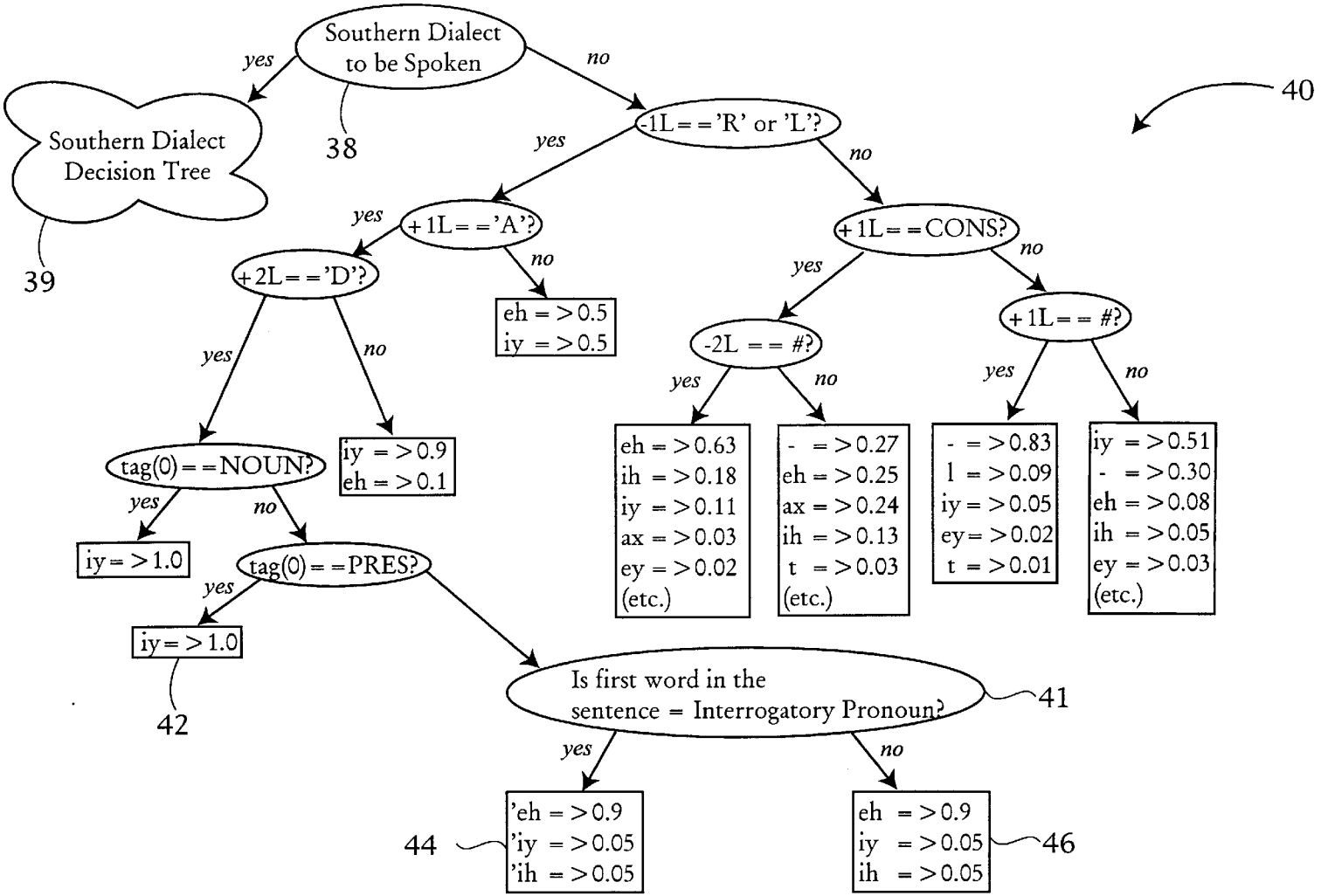
FIG. 2 is a tree diagram illustrating a letter-syntax-context-dialect mixed decision tree.

FIG. 2 shows an example of a letter-syntax-context-dialect decision tree 40 applicable to the letter "E" in the word "READ." The decision tree comprises a plurality of internal nodes (illustrated as ovals in the Figure) and a plurality of leaf nodes (illustrated as rectangles in the Figure). Each internal node is populated with a yes-no question. Yes-no questions are questions that can be answered either yes or no. In the letter-syntax-context-dialect decision tree 40 these questions are directed to: a given letter (e.g., in this case the letter "E") and its neighboring letters in the input sequence; or the syntax of the word in the sentence (e.g., noun, verb, etc.); or the context and dialect of the sentence. Note in FIG. 2 that each internal node branches either left or right depending on whether the answer to the associated question is yes or no.

Preferably, the first internal node inquires about the dialect to be spoken. Internal node 38 is representative of such an inquiry. If the southern dialect is to be spoken, then southern dialect decision tree 39 is coursed through which ultimately produces phoneme values at the leaf nodes which are more distinctive of a southern dialect.

The abbreviations used in FIG. 2 are as follows: numbers in questions, such as "+1" or "−1" refer to positions in the spelling relative to the current letter. The symbol L represents a question about a letter and its neighboring letters. For example, "−1L=='R' or 'L'?" means "is the letter before the current letter (which is 'E') an 'L' or an 'R'?". Abbreviations 'CONS' and 'VOW' are classes of letters: consonant and vowel. The symbol '#' indicates a word boundary. The term 'tag(i)' denotes a question about the syntactic tag of the ith word, where i=0 denotes the current word, i=−1 denotes the preceding word, i=+1 denotes the following word, etc. Thus, "tag(0)==PRES?" means "is the current word a present-tense verb?".

The leaf nodes are populated with probability data that associate possible phoneme pronunciations with numeric values representing the probability that the particular phoneme represents the correct pronunciation of the given letter. The null phoneme, i.e., silence, is represented by the symbol '−'.

For example, the "E" in the present-tense verbs "READ" and "LEAD" is assigned its correct pronunciation, "iy" at leaf node 42 with probability 1.0 by the decision tree 40. The "E" in the past tense of "read" (e.g., "Who read a book") is assigned pronunciation "eh" at leaf node 44 with probability 0.9.

Decision trees 10 (of FIG. 1) preferably includes context-related questions. For example, context-related question of internal nodes may examine whether the word "you" is preceded by the word "did." In such a context, the "y" in "you" is typically pronounced in colloquial speech as "ja".

The present invention also generates prosody-indicative data, so as to convey stress, pitch, grave, or pause aspects when speaking a sentence. Syntax-related questions help to determine how the phoneme is to be stressed, or pitched or graved. For example, internal node 41 (of FIG. 2) inquires whether the first word in the sentence is an interrogatory pronoun, such as "who" in the exemplary sentence "who read a book?" Since in this example, the first word in this example is an interrogatory pronoun, then leaf node 44 with its phoneme stress is selected. Leaf node 46 illustrates the other option where the phonemes are not stressed.

As another example, in an interrogative sentence, the phonemes of the last syllable of the last word in the sentence would have a pitch mark so as to more naturally convey the questioning aspect of the sentence. Still another example includes the present invention able to accommodate natural pausing in speaking a sentence. The present invention includes such pausing detail by asking questions about punctuation, such as commas and periods.

The text-based pronunciation generator 16 (FIG. 1) thus uses decision trees 10 to construct one or more pronunciation hypotheses that are stored in list 18. Preferably each pronunciation has associated with it a numerical score arrived at by combining the probability scores of the individual phonemes selected using decision trees 10. Word pronunciations may be scored by constructing a matrix of possible combinations and then using dynamic programming to select the n-best candidates.

Alternatively, the n-best candidates may be selected using a substitution technique that first identifies the most probable word candidate and then generates additional candidates through iterative substitution, as follows. The pronunciation with the highest probability score is selected first, by multiplying the respective scores of the highest-scoring phonemes (identified by examining the leaf nodes) and then using this selection as the most probable candidate or first-best word candidate. Additional (n-best) candidates are then selected by examining the phoneme data in the leaf nodes again to identify the phoneme, not previously selected, that has the smallest difference from an initially selected phoneme. This minimally-different phoneme is then substituted for the initially selected one to thereby generate the second-best word candidate. The above process may be repeated iteratively until the desired number of n-best candidates have been selected. List 18 may be sorted in descending score order, so that the pronunciation judged the best by the letter-only analysis appears first in the list.

Decision trees 10 frequently produce only moderately successful results. This is because these decision trees have no way of determining at each letter what phoneme will be generated by subsequent letters. Thus decision trees 10 can generate a high scoring pronunciation that actually would not occur in natural speech. For example, the proper name, Achilles, would likely result in a pronunciation that phoneticizes both ll's: ah-k-ih-l-l-iy-z. In natural speech, the second l is actually silent: ah-k-ih-l-iy-z. The pronunciation generator using decision trees 10 has no mechanism to screen out word pronunciations that would never occur in natural speech.

The second stage 20 of the pronunciation system 8 addresses the above problem. A phoneme-mixed tree score estimator 20 uses the set of phoneme-mixed decision trees 12 to assess the viability of each pronunciation in list 18. The score estimator 20 works by sequentially examining each letter in the input sequence 14 along with the phonemes assigned to each letter by text-based pronunciation generator 16.

Figure 3:
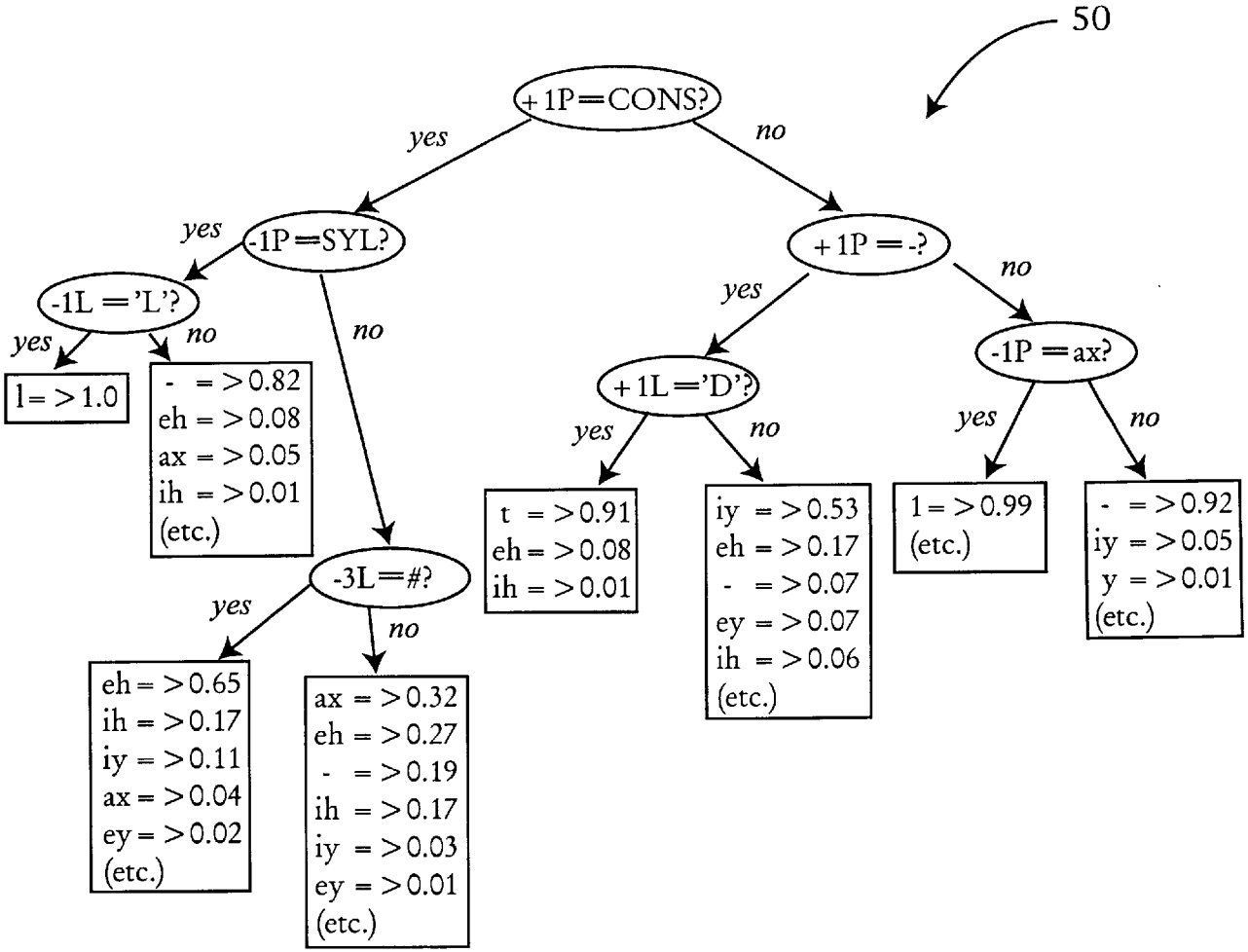
FIG. 3 is a tree diagram illustrating a phoneme-mixed decision tree which examines pronunciation at the phoneme level in accordance with the invention.

Similar to decision trees 10, the set of phoneme-mixed decision trees 12 has a mixed tree for each letter of the alphabet. An exemplary mixed tree is shown in FIG. 3 by reference numeral 50. Similar to decision trees 10, the mixed tree has internal nodes and leaf nodes. The internal nodes are illustrated as ovals and the leaf nodes as rectangles in FIG. 3. The internal nodes are each populated with a yes-no question and the leaf nodes are each populated with probability data. Although the tree structure of the mixed tree resembles that of decision trees 10, there is one important difference. An internal node can contain a question about the phoneme associated with that letter and neighboring phonemes corresponding to that sequence.

The abbreviations used in FIG. 3 are similar to those used in FIG. 2, with some additional abbreviations. The symbol P represents a question about a phoneme and its neighboring phonemes. The abbreviations CONS and SYL are classes, namely consonant and syllabic. For example, the question "+1P==CONS?" means "Is the phoneme in the +1 position a consonant?" The numbers in the leaf nodes give phoneme probabilities as they did in decision trees 10.

The phoneme-mixed tree score estimator 20 rescores each of the pronunciations in list 18 based on the phoneme-mixed tree questions 12 and using the probability data in the leaf nodes of the mixed trees. If desired, the list of pronunciations may be stored in association with the respective score as in list 22. If desired, list 22 can be sorted in descending order so that the first listed pronunciation is the one with the highest score.

In many instances the pronunciation occupying the highest score position in list 22 will be different from the pronunciation occupying the highest score position in list 18. This occurs because the phoneme-mixed tree score estimator 20, using the phoneme-mixed trees 12, screens out those pronunciations that do not contain self-consistent phoneme sequences or otherwise represent pronunciations that would not occur in natural speech.

In the preferred embodiment, phoneme-mixed tree score estimator 20 utilizes sentence rate calculator 52 in order to determine rate data for the pronunciations in list 22. Moreover, estimator 20 utilizes phoneme-mixed trees that allow questions about dialect to be examined and that also allow questions to determine stress and other prosody aspects at the leaf nodes in a manner similar to the aforementioned approach.

If desired a selector module 24 can access list 22 to retrieve one or more of the pronunciations in the list. Typically selector 24 retrieves the pronunciation with the highest score and provides this as the output pronunciation 26.

As noted above, the pronunciation generator depicted in FIG. 1 represents only one possible embodiment employing the mixed tree approach of the invention. In an alternate embodiment, the output pronunciation or pronunciations selected from list 22 can be used to form pronunciation dictionaries for both speech recognition and speech synthesis applications. In the speech recognition context, the pronunciation dictionary may be used during the recognizer training phase by supplying pronunciations for words that are not already found in the recognizer lexicon. In the synthesis context the pronunciation dictionaries may be used to generate phoneme sounds for concatenated playback. The system may be used, for example, to augment the features of an E-mail reader or other text-to-speech application.

The mixed-tree scoring system (i.e., letter, syntax, context, and phoneme) of the invention can be used in a variety of applications where a single one or list of possible pronunciations is desired. For example, in a dynamic on-line language learning system, a user types a sentence, and the system provides a list of possible pronunciations for the sentence, in order of probability. The scoring system can also be used as a user feedback tool for language learning systems. A language learning system with speech recognition capability is used to display a spelled sentence and to analyze the speaker's attempts at pronouncing that sentence in the new language. The system indicates to the user how probable or improbable his or her pronunciation is for that sentence.

While the invention has been described in its presently preferred form it will be understood that there are numerous applications for the mixed-tree pronunciation system. Accordingly, the invention is capable of certain modifications and changes without departing from the spirit of the invention as set forth in the appended claims.

It is claimed:

1. An apparatus for generating at least one phonetic pronunciation for an input sequence of letters selected from a predetermined alphabet, said sequence of letters forming words which substantially adhere to a predetermined syntax, said apparatus comprising:

an input device for receiving syntax data indicative of the syntax of said words in said input sequence;

a computer storage device for storing a plurality of text-based decision trees having questions indicative of predetermined characteristics of said input sequence; said predetermined characteristics including letter-related questions about said input sequence, said predetermined characteristics also including characteristics selected from the group consisting of syntax-related questions, context-related questions, dialect-related questions or combinations thereof, said text-based decision trees having internal nodes representing questions about predetermined characteristics of said input sequence;

said text-based decision trees further having leaf nodes representing probability data that associates each of said letters with a plurality of phoneme pronunciations; and a text-based pronunciation generator connected to said text-based decision trees for processing said input sequence of letters and generating a first set of phonetic pronunciations corresponding to said input sequence of letters based upon said text-based decision trees.

2. The apparatus of claim 1 further comprising:

a phoneme-mixed tree score estimator connected to said text-based pronunciation generator for processing said first set to generate a second set of scored phonetic pronunciations, the scored phonetic pronunciations representing at least one phonetic pronunciation of said input sequence.

3. The apparatus of claim 2 further comprising:

a plurality of phoneme-mixed decision trees having a first plurality of internal nodes representing questions about said predetermined characteristics and having a second plurality of internal nodes representing questions about a phoneme and its neighboring phonemes in said given sequence, said phoneme-mixed decision trees further having leaf nodes representing probability data that associates said given letter with a plurality of phoneme pronunciations;

said phoneme-mixed tree score estimator being connected to said phoneme-mixed decision trees for generating said second set of scored phonetic pronunciations.

4. The apparatus of claim 3 wherein said second set includes a plurality of pronunciations each with an associated score derived from said probability data and further comprising a pronunciation selector receptive of said second set and operable to select one pronunciation from said second set based on said associated score.

5. The apparatus of claim 3 wherein said phoneme-mixed tree score estimator rescores said n-best pronunciations based on said phoneme-mixed decision trees.

6. The apparatus of claim 1 wherein said text-based pronunciation generator produces a predetermined number of different pronunciations corresponding to a given input sequence.

7. The apparatus of claim 1 wherein said text-based pronunciation generator produces a predetermined number of different pronunciations corresponding to a given input sequence and representing the n-best pronunciations according to said probability data.

8. The apparatus of claim 1 wherein said phoneme-mixed tree score estimator constructs a matrix of possible phoneme combinations representing different pronunciations.

9. The apparatus of claim 8 wherein said phoneme-mixed tree score estimator selects the n-best phoneme combinations from said matrix using dynamic programming.

10. The apparatus of claim 8 wherein said phoneme-mixed tree score estimator selects the n-best phoneme combinations from said matrix by iterative substitution.

11. The apparatus of claim 3 further comprising a speech recognition system having a pronunciation dictionary used for recognizer training and wherein at least a portion of said second set populates said dictionary to supply pronunciations for words based on their spelling.

12. The apparatus of claim 3 further comprising a speech synthesis system receptive of at least a portion of said second set for generating an audible synthesized pronunciation of words based on their spelling.

13. The apparatus of claim 12 wherein said speech synthesis system is incorporated into an e-mail reader.

14. The apparatus of claim 12 wherein said speech synthesis system is incorporated into a dictionary for providing a list of possible pronunciations in order of probability.

15. The apparatus of claim 1 further comprising:

a language learning system that displays a spelled sentence and analyzes a speaker's attempt at pronouncing that sentence using at least one of said text-based trees and one of said phoneme-mixed decision trees to indicate to the speaker how probable the speaker's pronunciation was for that sentence.

16. The apparatus of claim 1 further comprising:

a syntax tagger module connected to said input device for associating syntax-indicative data to the words of the input sequence in order to generate said syntax data.

17. A method for generating at least one phonetic pronunciation for an input sequence of letters selected from a predetermined alphabet, said sequence of letters forming words which substantially adhere to a predetermined syntax, comprising the steps of:

receiving syntax data indicative of the syntax of said words in said input sequence;

storing a plurality of text-based decision trees having questions indicative of predetermined characteristics of said input sequence, said predetermined characteristics including letter-related questions about said input sequence, said predetermined characteristics also including characteristics selected from the group consisting of syntax-related questions, context-related questions, dialect-related questions or combinations thereof, said text-based decision trees having internal nodes representing questions about said predetermined characteristics of said input sequence;

said text-based decision trees further having leaf nodes representing probability data that associates each of said letters with a plurality of phoneme pronunciations; and processing said input sequence of letters in order to generate a first set of phonetic pronunciations corresponding to said input sequence of letters based upon said text-based decision trees.

18. The method of claim 17 further comprising the step of:

generating rate data based upon context-related questions within said text-based decision trees, said rate data indicating the duration which words in a sentence are spoken.

19. The method of claim 17 further comprising the step of:

processing said first set to generate a second set of scored phonetic pronunciations, said second set of scored phonetic pronunciations representing at least one phonetic pronunciation of said input sequence.

20. The method of claim 19 further comprising the steps of:

providing a plurality of phoneme-mixed decision trees which have a first plurality of internal nodes representing questions about said predetermined characteristics and having a second plurality of internal nodes representing questions about a phoneme and its neighboring phonemes in said given sequence, said phoneme-mixed decision trees further having leaf nodes representing probability data that associates said given letter with a plurality of phoneme pronunciations;

generating said second set of scored phonetic pronunciations using said phoneme-mixed decision trees.

21. The method of claim 20 wherein said second set includes a plurality of pronunciations each with an associated score derived from said probability data, said method further comprising the step of:

selecting one pronunciation from said second set based on said associated score.

22. The method of claim 20 further comprising the step of:

rescoring said n-best pronunciations based on said phoneme-mixed decision trees.

23. The method of claim 17 further comprising the step of:

producing a predetermined number of different pronunciations corresponding to a given input sequence.

24. The method of claim 17 further comprising the step of:

producing a predetermined number of different pronunciations corresponding to a given input sequence and representing the n-best pronunciations according to said probability data.

25. The method of claim 17 further comprising the step of:

generating a matrix of possible phoneme combinations representing different pronunciations.

26. The method of claim 25 further comprising the step of:

selecting the n-best phoneme combinations from said matrix using dynamic programming.

27. The method of claim 25 further comprising the step of:

selecting the n-best phoneme combinations from said matrix by iterative substitution.

28. The method of claim 20 further comprising the step of:

providing a speech recognition system having a pronunciation dictionary used for recognizer training and wherein at least a portion of said second set populates said dictionary to supply pronunciations for words based on their spelling.

29. The method of claim 20 further comprising the step of:

providing a speech synthesis system receptive of at least a portion of said second set for generating an audible synthesized pronunciation of words based on their spelling.

30. The method of claim 29 wherein said speech synthesis system is incorporated into an e-mail reader.

31. The method of claim 29 wherein said speech synthesis system is incorporated into a dictionary for providing a list of possible pronunciations in order of probability.

32. The method of claim 17 further comprising the step of:

providing a language learning system that displays a spelled sentence and analyzes a speaker's attempt at pronouncing that sentence using at least one of said text-based trees and one of said phoneme-mixed decision trees to indicate to the speaker how probable the speaker's pronunciation was for that sentence.

33. The method of claim 17 further comprising the step of:

using a syntax tagger module for associating syntax-indicative data to the words of the input sequence in order to generate said syntax data.

34. The method of claim 17 wherein said leaf nodes of said text-based decision trees includes stress indicative data associated with said phoneme pronunciations.

* * * * *